US006056147A

United States Patent [19]

Jarman

[11] Patent Number: 6,056,147

[45] **Date of Patent: *May 2, 2000**

[54] SYSTEM FOR RELEASABLY SECURING A MULTIPART RECEPTACLE

[76] Inventor: Murray Jarman, 716 Sunset Rd., Boynton Beach, Fla. 33435

[ * ] Notice: This patent is subject to a terminal disclaimer.

[21] Appl. No.: 09/163,905

[22] Filed: Sep. 30, 1998

Related U.S. Application Data

[63] Continuation-in-part of application No. 29/083,117, Feb. 4, 1998.

[51] Int. Cl.[7] ..... B65F 1/06

[52] U.S. Cl. ..... 220/495.11; 24/115 H; 220/495.01

[58] Field of Search ..... 220/495.01, 495.08, 220/495.11; 24/115 H, 115 G; 383/42, 81

[56] References Cited

U.S. PATENT DOCUMENTS

| | | | |
|---|---|---|---|
| D. 404,869 | 1/1999 | Jarman | D34/10 |
| 704,833 | 7/1902 | Johnson . | |
| 756,496 | 4/1904 | Harger . | |
| 3,180,384 | 4/1965 | Seifert . | |
| 3,927,445 | 12/1975 | Pavlish . | |
| 3,964,630 | 6/1976 | Getz . | |
| 4,312,489 | 1/1982 | Paetzold . | |
| 4,401,327 | 8/1983 | Caines | 289/1.2 |
| 4,708,307 | 11/1987 | Daigle . | |
| 4,899,967 | 2/1990 | Johnson . | |
| 5,400,128 | 3/1995 | Michlin | 399/354 |
| 5,456,431 | 10/1995 | Iinisky . | |
| 5,536,005 | 7/1996 | Koff | 473/543 |
| 5,668,251 | 9/1997 | Malik et al. | 528/402 |

OTHER PUBLICATIONS

Vivus, Inc., Actis Venous Flow Controller Patient Instructions, Dec. 30, 1998, excerpt from website: product@vivus.com.

*Primary Examiner*—Allan N. Shoap
*Assistant Examiner*—Joe Merek
*Attorney, Agent, or Firm*—Quarles & Brady

[57] ABSTRACT

The present invention relates to a system for retaining a film lining within a trash receptacle. The system includes a lining, a container and a rim restraint. The rim restraint takes the form of an elongated resilient tube with first and second opened ends. The restraint further includes a multifaceted ball which is frictionally secured into one of the opened ends. The ball functions in keeping the restraint in a locked orientation. In order for the restraint to be positioned about a trash container it is formed into a closed loop. The closed loop configuration is achieved by joining the two free ends by way of a circular band. The system is completed by positioning the restraint about both a trash lining and container. Once properly positioned, restraint can be locked by pulling one of the free ends. The locked orientation is achieved when the circular band engages one of the facets of the ball. The restraint can be subsequently unlocked by pulling on the opposite free end of the restraint.

9 Claims, 3 Drawing Sheets

SYSTEM FOR RELEASABLY SECURING A MULTIPART RECEPTACLE

CROSS-REFERENCE TO RELATED APPLICATION

This application is a continuation-in-part of co-pending application Ser. No. 29/083,117 filed Feb. 4, 1998.

Statement Regarding Federally Sponsored Research And Development

Not Applicable

Background of The Invention

1. Field of the Invention

The present invention relates to a rim restraint for securing the periphery of a liner to a trash receptacle. More specifically, the present invention relates to a rim restraint which has an increased constriction capacity and a locking means.

2. Description of Related Art

Devices for supporting flexible bags are known in the art. Typically, such supporting devices are made up of two or more interconnected pieces, which are connected about a supported bag. For example, U.S. Pat. No. 4,312,489 to Paetzold; U.S. Pat. No. 4,899,967 to Johnson; U.S. Pat. No. 5,456,431 to Ilnisky; U.S. Pat. No. 704,833 to Johnson; U.S. Pat. No. 3,180,384 to Seifert; U.S. Pat. No. 3,964,630 to Getz; and U.S Pat. No. 4,708,307 to Daigle all disclose various bag stands wherein at least two pieces are interconnected about the periphery of a supported bag. However, none of these devices is specifically adapted for securing a film liner to a container. Additionally, these devices suffer from the drawback of including multiple interconnected pieces, thereby requiring the use of two hands to secure a bag.

By contrast, U.S. Pat. No. 3,927,445 to Pavlish discloses a retainer for holding the upper edge of a flexible liner against the outer surface of a refuse container. The retainer, however, employs a slidable fastener with points which are adapted to engage the material of the retainer. Thus, the retainer is only secured with the points engaged into the retainer material. Consequently, this retainer has a tendency to wear out over multiple adjustments. Additionally, the fastener and the associated handle must both be manipulated in order for the retainer to be adjusted, thereby requiring two hand operation. Lastly, the retainer of Pavlish is formed from a flat band of material which has a poor strength to weight ratio.

U.S. Pat. 756,496 to Harger discloses a fastener which is formed from a strand of an inelastic material. The strand includes a stop formed from a knot of the strand material. A first disadvantage of Harger resides in its inelastic nature. The inelasticity prohibits the stand from adequately constricting the underlying package. A second disadvantage is that the inelastic nature prohibits a locking engagement between the ring and knotted stop. A third disadvantage is that a knot will always exhibit an inconsistent and irregular shape, and accordingly, will not provide much locking force, if any. What little tightness Harger can provide appears to be all or nothing. No varying degrees of tightness are available. More generally, the fastener of Harger does not contemplate securing a flexible liner to a rigid container, but rather simply functions in closing the opened end of a bag. Due to the simple function of Harger, neither a means for increased constriction, nor a locking means would be contemplated.

Lastly, the website at http://product @ vivus.com/frames/products/products.shtm discloses a venous flow controller sold by Vivus Incorporated of Mountain View Calif. Such controller is specifically for use by patients with erectile dysfunction. The site broadly discloses a closed loop device which appears to be adjustable. The Vivus device, being a medical device, is not designed to be tightly secured. Any adjusting means the Vivus device employs would be specifically adapted to provide a limited securement to prevent damage to body parts. Consequently, no means for increased constriction, nor any robust locking means is contemplated by the Vivus device.

SUMMARY OF THE INVENTION

The aforementioned disadvantages are overcome by the rim restraint of the present invention. One of the inventive arrangements takes the form of a trash receptacle system. This system includes a container having an interior and an upper opening defined by a peripheral edge. The system also incorporates a liner. The liner has a closed lower end and an opened upper end, with the closed lower end disposed within the interior of the container and the opened upper end of the liner disposed over the peripheral edge of the container. Lastly, the system employs a resilient tubular liner restraint. The restraint is defined by a wall thickness, a first end, a second end and an intermediate extent therebetween. A multifaceted ball is secured within the first end and functions in locking the restraint in a secured orientation. Furthermore, a collar is slidably positioned about the first and second ends to thereby close the liner restraint. The closed liner restraint is then adapted to be positioned over the opened upper end of the liner. Excess portions of the liner are folded down over the receptacle. Subsequently, the liner restraint is secured about the container by extending one end through the collar. This extension lockingly engages the multifaceted ball against the collar, and likewise pinches closed an adjacent intermediate extent of the tubular restraint.

This inventive arrangement thus allows for one handed adjustment of the restraint about the container and liner. Likewise, the restraint can be lockingly secured about the container with one hand. The inventive arrangement also enables an increased constriction capacity about the container. This constriction is achieved through the use of a resilient tubular restraint having a superior strength to weight ratio. The constriction is maintained by the engagement between the restraint collar and the multifaceted ball. More specifically, a plurality of flat or substantially flat facets of the ball are expressed through the resilient tubular wall, such that at least one of the facets, or a combination of facets, engages the circular collar. This engagement enables the restraint to be securely locked into place. The locking engagement and increased constriction capacity represent an advancement over the restraints of the prior art. The greater the flat surface area, the tighter the lock.

An additional advantageous feature comes from coating the tubular restraint with a resilient material having a low coefficient of sliding friction. This low friction coating enables either end of the restraint to be easily passed through the collar, thereby facilitating one handed adjustment. Furthermore, this low friction coating has the unexpected result of enabling a secure fitting between the restraint and the underlying film lining after the restraint is tightened, due to a coefficient of static friction that is high enough to restrain the liner against sliding movement.

Another advantageous feature results from employing a second multifaceted ball within the second end of the restraint. With two faceted balls utilized, the locked orientation can be achieved by extending either end of the restraint.

Still yet another advantageous feature is realized by utilizing a wall thickness which is sufficient to prevent the multifaceted ball from expressing itself until the tubular restraint is secured.

DETAILED DESCRIPTION OF PREFERRED EMBODIMENTS

Figure 1:
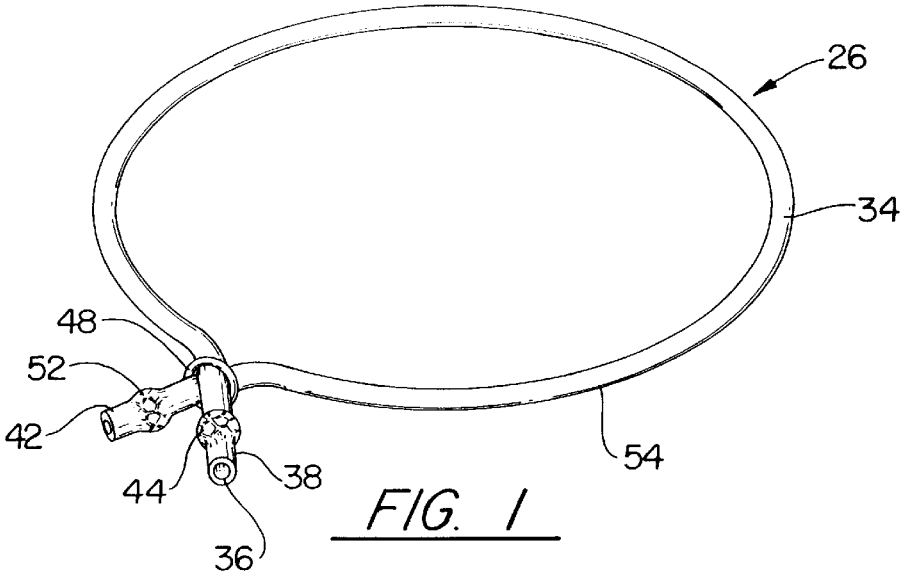
FIG. 1 is a perspective view of the rim restraint of the present invention.
Figure 2:
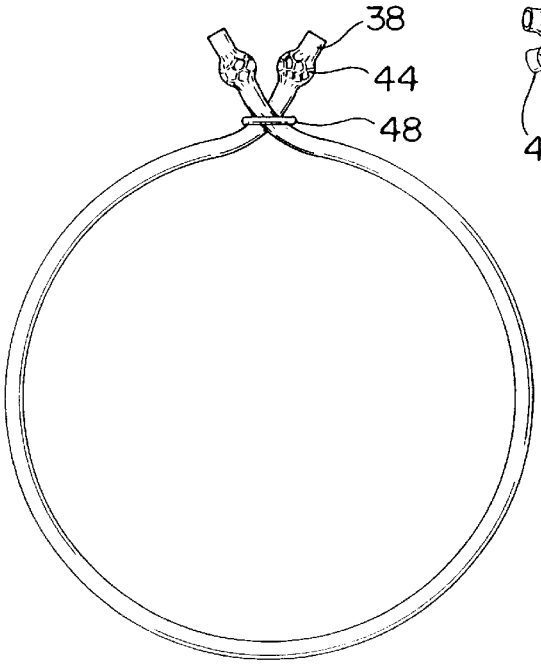
FIG. 2 is a plan view of the rim restraint of the present invention.
Figure 3:
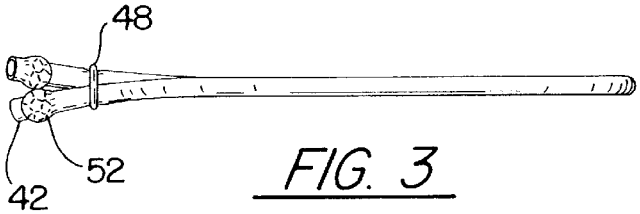
FIG. 3 is a side elevation of the rim restraint of the present invention.
Figure 4:
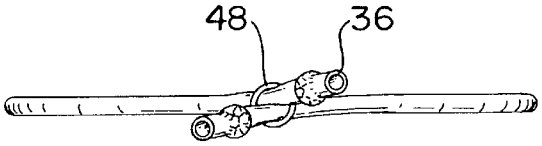
FIG. 4 is a front elevation of the rim restraint of the present invention.
Figure 5:
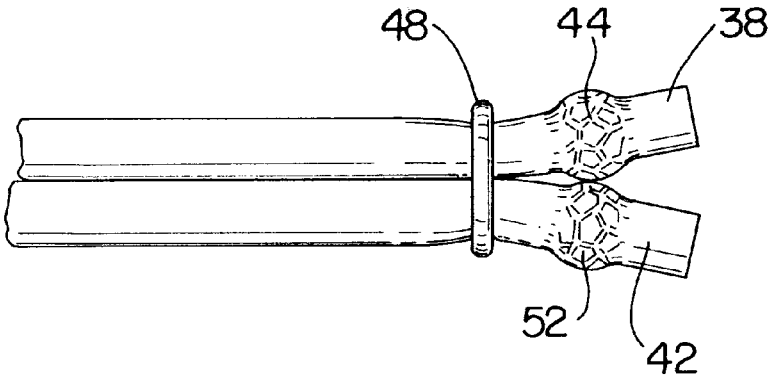
FIG. 5 is a detailed view of the collar and faceted balls.
Figure 6:
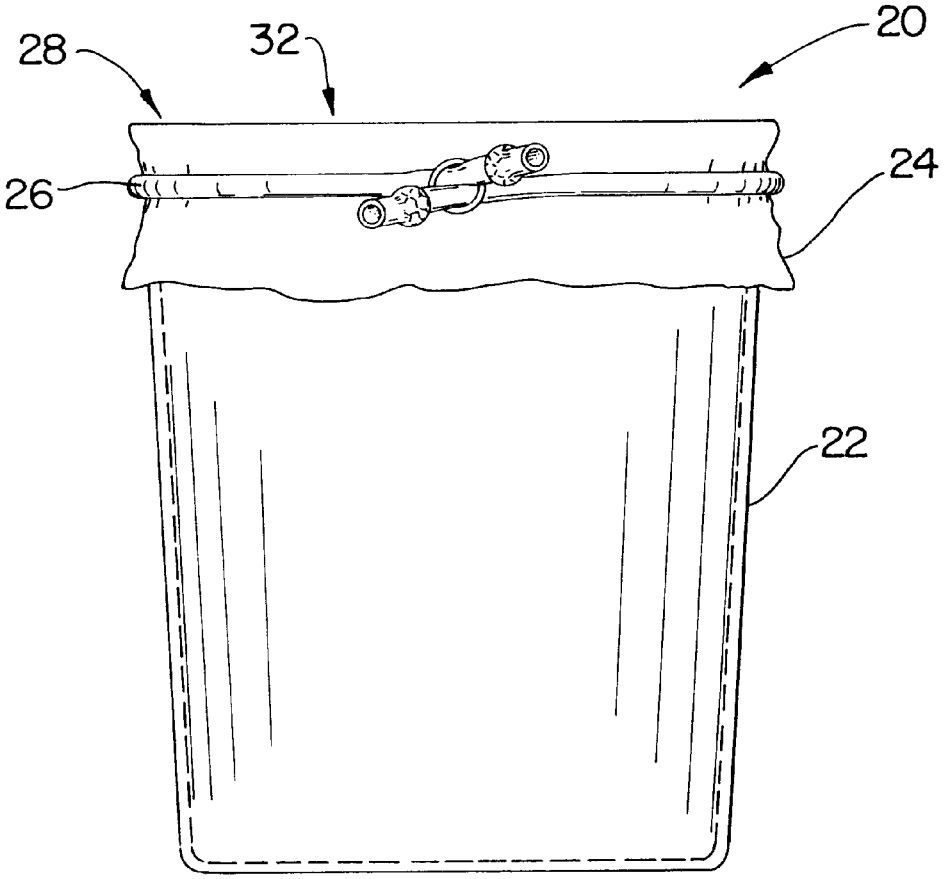
FIG. 6 is a view of the system including the receptacle and film lining.

The present invention relates to a system for retaining a film lining within a trash receptacle. The system includes a lining, a container and a rim restraint. The rim restraint takes the form of an elongated resilient tube with first and second opened ends. The restraint further includes a multifaceted ball which is frictionally secured into one of the opened ends. The ball functions in keeping the restraint in a locked orientation. In order for the restraint to be positioned about a trash container the restraint is formed into a closed loop. The closed loop configuration is achieved by joining the two free ends by way of a circular band or ring. The system is completed by positioning the restraint about both a trash lining and container. Once properly positioned, the restraint can be locked by pulling one of the free ends. The locked orientation is achieved when the circular band engages one of the facets of the ball, and the opposite length of tubing is locked between the ball and the band or ring. The restraint can be subsequently unlocked by pulling on the opposite free end of the restraint. Although the present invention has been briefly described as a system, it more broadly pertains to a restraint device which can be releasably secured about any object. The various components of the present system, as well as the steps of the corresponding method, will be described in greater detail hereinafter.

The system 20 of the present invention has three components: a container 22, a container liner 22, and a rim restraint 26. The container is defined by an interior, and an upper opening 28. The upper opening 28, in turn, is defined by a peripheral edge. This container 22 can be a conventional trash container of various sizes and shapes. The container dimensions are not critical insomuch as the present system 20 can be used on a container 22 of any size or shape. Furthermore, the restraint 26 can be used in conjunction with various sized receptacle openings, including for example rectangular and circular openings.

The liner 24 forms the second component of the present invention. Such liner 24 is defined by a closed lower end and an opened upper end 32. In the preferred embodiment, the liner 24 is made from a thin plastic film. It is within the scope of the present invention, however, to employ other materials such as cloth or rubber. For many trash receptacles the liner will be a commercially available plastic trash bag. In a conventional manner, the closed lower end of the liner 24 is adapted to be disposed within the interior of the container 22. When so positioned, the opened upper end 32 of the liner 24 is adapted to be disposed over the peripheral edge of the container 22. Items can then be deposited into the interior of both the container 22 and liner 24. Subsequently, the liner 24 can be removed from the interior of the container 22 for easy disposal.

The system 20 is completed by securing a rim restraint 26 about the periphery of the liner 24 and container 22. In the preferred embodiment, the restraint 26 takes the form of a length of tubing 34 which is both radially and axially resilient. The tubing 34 is defined by a tubular wall thickness 36, inner and outer diameters, first and second ends (38 and 42 respectively), as well as an intermediate length.

The present invention also contemplates the use of locking means in conjunction with the tubing 34 for maintaining the restraint 26 in a secured positioned about the periphery of the liner 24 and receptacle 22. In the preferred embodiment, this locking means takes the form of at least one multifaceted ball or bead 44 which is secured within one of the ends of the tubing 34. The ball 44 can be formed from a plastic or metal material. The relationship between the diameter of the tubing 34 and the diameter of the faceted ball 44 is such that the ball 44 is frictionally secured within the inner walls of the tubing 34. The size of the tubular walls 36 also forms an important aspect of the present invention. More specifically, the tubular wall thickness 36 is optimally chosen to permit the multifaceted ball 44 to more fully express its shape upon the outer surface of the tubing 34 when the tubing 34 is in a tensioned state. At the same time, the wall thickness 36 is sufficient to provide the necessary strength to the restraint. In other words, when the tubing 34 is axially deformed the individual ball facets 46 are more clearly defined upon the exterior surface of the restraint 26. Such faceted expression enables the restraint 26 to be more securely fastened about the periphery of a container 22, in a manner more fully explained hereinafter.

The rim restraint 26 is formed into a closed loop by way of a circular collar or ring 48. The collar 48 is formed from either a metal or plastic material, and is slidably positioned about the ends of the restraint 26. In this manner, the restraint 26 is formed into a closed loop of an adjustable size. In order to optimally engage the tubing 34, the collar 48 has a diameter which is less than two times the outer diameter of the tubing 34. In other words, the two sections of the tubing are partially compressed within the collar even when the restraint is not under tension.

Figure 7:
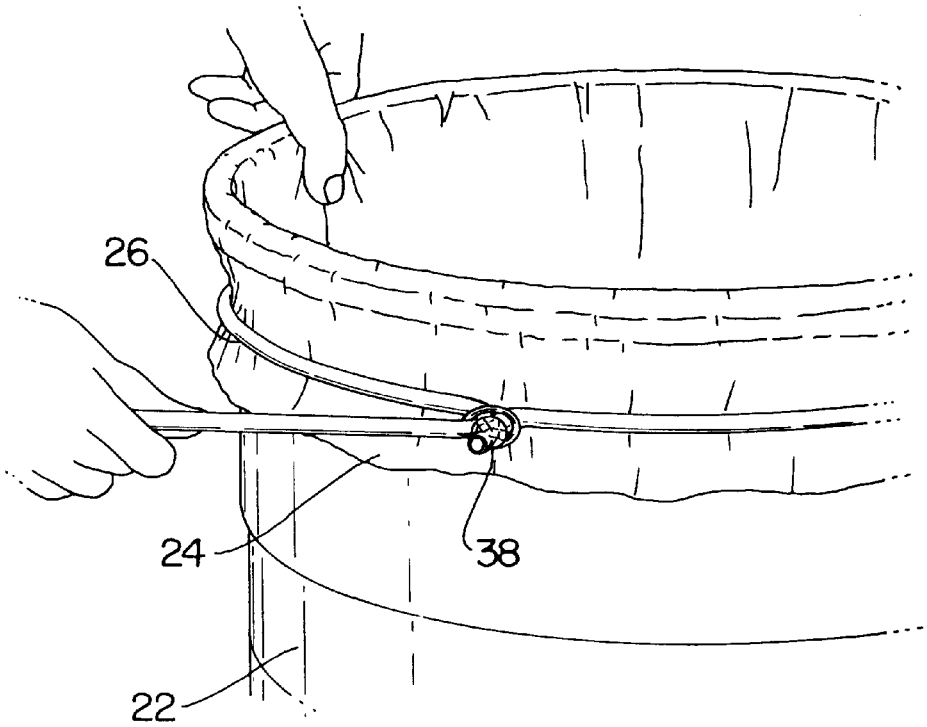
FIG. 7 illustrates tightening the rim restraint.
Figure 8:
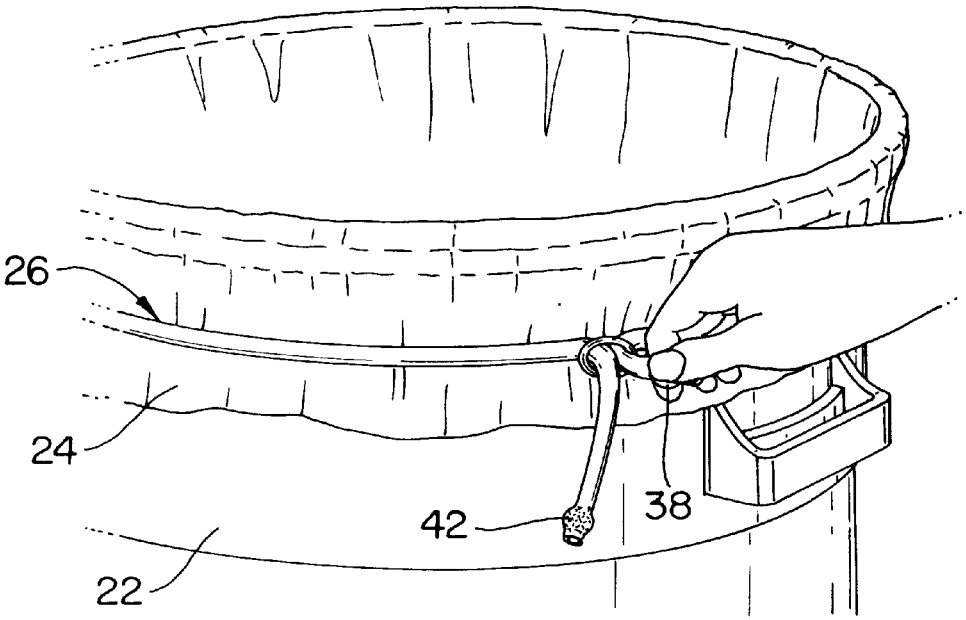
FIG. 8 illustrates loosening the rim restraint.

With the restraint 26 closed, it can be readily positioned about the opened upper end 32 of the liner 24. Thereafter, the liner 24 can be locked, or secured, into place as shown in FIG. 7. This locking is achieved by extending one end of the liner restraint 26 through the collar 48. This extension has two effects. First, the size of the closed loop is reduced. Second, at least one facet 46 of the multifaceted ball 44 becomes lockingly engaged against the collar 48. More specifically, the collar 48 positively engages at least one ball facet 46 which is expressed through the tubing thickness 36. Additionally, at least one other facet engages the opposite end of the tubing, this opposite end also being pinched in the locked orientation. The collar 48 can also engage multiple facets of the ball 44. To facilitate an optimal collar-ball engagement the ball 44 is slightly smaller than the inner diameter of the collar 48. Additionally, in the locked orientation, the length of intermediate tubing opposite the ball 44 is pinched by the circular collar 48. The restraint 26 is in the locked orientation when the collar 48 is engaged with the ball 44 and the opposing tubing is pinched. Once locked, the closed loop maintains its reduced size, and the liner 24 is fixedly secured about the periphery of the container 22. Consequently, the liner 24 maintains its position over the periphery of the receptacle 22, despite heavy objects being deposited within the liner 24. The restraint is loosened by pulling on the other end of the tubular member, as shown in FIG. 8.

In an additional embodiment of the present invention a second multifaceted ball 52 is similarly secured within the second, opposite end 42 of the restraint 26. This second multifaceted ball 52 can be similar in all respects to the ball 44 described hereinabove. With a ball employed within each end of the restraint, the locking orientation can be achieved by pulling either of the two ends of the tubing 38 or 42. Namely, the pulling of a first end 38 results in the positive engagement of the multifaceted ball of the opposite end 42 and vice versa.

In an additional aspect of the present invention, the tube 34 is coated with a resilient low friction material 54. This coating 54 allows for either end of the tubing 34 to be readily slid through the collar 48 with little resistance. The coating 54, however, also permits the restraint 26 to maintain a positive engagement with the thin film of the liner 24.

The rim restraint, in the preferred embodiment, comes in two sizes. The various preferred dimensions, materials and geometries of the various restraint components for each size are listed below in Table 1. These specifications, however, are only preferred and other such specifications are within the scope of the present invention.

TABLE 1

| | Small Size | Large Size |
|---|---|---|
| Tubing | | |
| Inner Diameter | 3/16 inch | 1/4 inch |
| Outer Diameter | 5/16 inch | 6/16 inch |
| Wall Thickness | 1/16 inch | 1/16 inch |
| Length | 3.75 feet | 5.75 feet |
| Material | natural rubber latex | natural rubber latex |
| Faceted Balls | | |
| Diameter | 10 mm | 12 mm |
| Number of Facets | 34 | 34 |
| Material | plastic or metal | plastic or metal |
| Collar | | |
| Inner Diameter | 7/16 inch | 8/16 inch |
| Outer Diameter | 10/16 inch | 12/16 inch |
| Thickness | 3/32 inch | 2/16 inch |
| Material | plastic or metal | plastic or metal |

The method of the present invention broadly contemplates positioning a liner within a container, and then subsequently securing and locking a resilient restraint about the periphery of both the container and liner. The details of these various method steps will be described in greater detail hereinafter.

The method steps of the present invention are preformed with the use of an open-topped container, a liner and a resilient tubular restraint. The first step involves disposing the liner about the container, with an opened upper end of the liner being disposed over a peripheral edge of the container.

Subsequently, the resilient restraint is positioned about the opened upper end of the liner. This is achieved by having the restraint oriented in a closed loop. More specifically, the first and second ends of the restraint are joined together by a collar thereby providing a closed loop of an adjustable size.

Next, the resilient restraint is secured into a constricted orientation in such a manner that the liner is disposed between the restraint and the container.

A locking orientation is thereafter achieved through the use of first and second locking members. Specifically, a first face of the first locking member is frictionally engaged with a first portion of the second locking member. Preferably, the first locking member is disposed inside of a portion of the tubular restraint. At the same time, a second face of the first locking member is frictionally engaged with a second portion of the second locking member. These frictional engagements are achieved simultaneously with a second portion of the tubular restraint being pinched between the second face of the first locking member and the second portion of the second locking member. Thus, the frictionally engaging steps and the pinching step together lock the restraint in the constricted orientation.

As an alternative embodiment, it is possible to mold a locking configuration, such as the faceted surface, directly into the elastic tubular member, although in such an embodiment, the molded, faceted portion is more effective if at least somewhat less elastic than the rest of the tubular member.

Overall, the inventive arrangements provide a number of advantages. Trash bags can be locked in place, so that stuffing the trash receptacle is easier. The frustration of holding the bag open when loading is ended. Since trash bags never slip into the trash receptacle during loading, removal of the trash bag never entails reaching in to retrieve the top edge of the trash bag, which may be in contact with the trash. Moreover, trash never finds it way between the trash bag and the trash receptacle. Yard work is easier because leaves and other debris can be raked into the receptacle without requiring a second person to hold the trash bag in place. The adjustable design enables use with receptacles of virtually every shape and size. Finally, animals can be deterred from getting into the trash receptacles.

What is claimed is:

1. A trash receptacle system comprising:

a container having an interior, and an upper opening defined by a peripheral edge;

a liner having a closed lower end and an opened upper end, the opened upper end of the liner being disposed over the peripheral edge of the container and the closed lower end depending downwardly from the peripheral edge of the container;

a resilient tubular liner restraint having a wall thickness, a first end, a second end and an intermediate extent therebetween;

a multifaceted ball secured within the first end;

a collar slidably positioned about the first and second ends; and the closed liner restraint being positioned over the opened upper end of the liner, the liner restraint being secured about the container by extending one end of the liner restraint through the collar to thereby lockingly engage the multifaceted ball against the collar and pinch closed an adjacent intermediate extent of the tubular restraint.

2. The system as described in claim 1 further comprising a second multifaceted ball secured within the second end.

3. The system as described in claim 1 wherein:

the collar has a diameter and the restraint has an outer diameter; and, the diameter of the collar is less than two times the outer diameter of the tubing.

4. The system as described in claim 1 wherein the multifaceted ball has a diameter which is slightly smaller than an inner diameter of the collar.

5. An apparatus adapted to be releasably secured about an object, the apparatus comprising:

a resilient tubular liner restraint having a first end, a second end and an intermediate extent therebetween, a multifaceted ball secured within the first end, a collar slidably positioned about the first and second ends to thereby close the liner restraint, the closed liner restraint adapted to be positioned about an object;

the liner restraint adapted to be secured about the object by extending one end of the liner restraint through the collar to thereby lockingly engage the multifaceted ball against the collar and pinch close an adjacent intermediate extent of the liner restraint.

6. The apparatus as described in claim 5 further comprising a second multifaceted ball secured within the second end.

7. The apparatus as described in claim 5 wherein:

the collar has a diameter and the restraint has an outer diameter; and, the diameter of the collar is less than two times the outer diameter of the tubing.

8. The apparatus as described in claim 5 wherein the multifaceted ball has a diameter which is slightly smaller than an inner diameter of the collar.

9. A method for releasably securing a liner in an open-topped container with a resilient tubular restraint, comprising the steps of:

disposing the liner about the container, an opened upper end of the liner being disposed over a peripheral edge of the container;

positioning the resilient restraint about the opened upper end of the liner, with first and second ends of the restraint joined together by a collar;

securing the resilient restraint into a constricted orientation, with the liner disposed between the restraint and the container;

engaging a first face of a first locking member disposed inside a portion of said tubular restraint with a first portion of a second locking member;

engaging a second face of said first locking member with a second portion of said second locking member; and, pinching a second portion of said tubular restraint between said second face and said second portion of said second locking member, whereby the engaging steps and the pinching step together lock the restraint in the constricted orientation.

* * * * *